US006902244B1

(12) United States Patent
Chen

(10) Patent No.: US 6,902,244 B1
(45) Date of Patent: Jun. 7, 2005

(54) DRAWER RAIL STRUCTURE ALLOWING ADJUSTING OF VERTICAL POSITION OF DRAWER FRONT PANEL

(75) Inventor: Henry Chen, Taipei (TW)

(73) Assignee: Protrend Co., Ltd., Taipei (TW)

( * ) Notice: Subject to any disclaimer, the term of this patent is extended or adjusted under 35 U.S.C. 154(b) by 0 days.

(21) Appl. No.: 10/738,391

(22) Filed: Dec. 15, 2003

(51) Int. Cl.[7] ..... A47B 88/00
(52) U.S. Cl. ..... 312/334.4; 312/334.12
(58) Field of Search ..... 312/334.4, 334.7, 312/334.8, 334.12, 330.1, 334.18, 334.19, 312/334.21, 350; 384/22

(56) References Cited

U.S. PATENT DOCUMENTS 2,523,821 A * 9/1950 Fox ..... 312/334.4
2,551,843 A * 5/1951 Knuth ..... 312/334.4
3,099,501 A * 7/1963 Hillson et al. ..... 384/19
4,291,929 A * 9/1981 Faust ..... 312/334.4
4,615,572 A * 10/1986 Nelson ..... 612/334.4
5,588,729 A * 12/1996 Berger ..... 312/334.4
5,722,749 A * 3/1998 Domenig ..... 312/334.4
2002/0190618 A1 * 12/2002 Salice ..... 312/334.4
2004/0145286 A1 * 7/2004 Kim ..... 312/334.4

FOREIGN PATENT DOCUMENTS

DE 24 32 329 * 12/1975

* cited by examiner

*Primary Examiner*—Janet M. Wilkens
(74) *Attorney, Agent, or Firm*—W. Wayne Liauh

(57) ABSTRACT

A drawer rail structure includes two guide rails mounted to a piece of furniture, and two slide rails mounted to a drawer. Each of the guide rails is provided at a front end with a first roller, and each of the slide rails at a rear end with a second roller and at an upper edge with an inward stop plate. The stop plates press against tops of the first rollers when the second rollers rotate along the guide rails, guiding the drawer to slide in correct directions. An adjusting screw is provided at an outer end of each stop plate, and a spring plate is located below the adjusting screw to press against the top of the first roller. When the adjusting screw is turned to push the spring plate to a different height, a front panel of the drawer may be adjusted to a different vertical position.

1 Claim, 4 Drawing Sheets

DRAWER RAIL STRUCTURE ALLOWING ADJUSTING OF VERTICAL POSITION OF DRAWER FRONT PANEL

FIELD OF THE INVENTION

The present invention relates to a drawer rail structure allowing adjusting of a vertical position of a drawer front panel. With the present invention, a front panel of a drawer may be easily adjusted in vertical position and side inclination, so as to locate in a fully horizontal state. Moreover, a space between two vertically adjacent drawer front panels may also be adjusted through the present invention to give the furniture using the drawers a quality appearance.

BACKGROUND OF THE INVENTION

FIGS. 1 and 2 illustrate a conventional rail structure 12 for a drawer 11. The rail structure 12 mainly includes a pair of guide rails 13 for fixedly mounting to predetermined positions on a piece of furniture 10, and a pair of slide rails 14 for fixedly mounting to predetermined positions on two side panels of the drawer 11. Each of the guide rails 13 is provided at a front end with a first roller 15, and each of the slide rails 14 is provided at an upper edge with an inward stop plate 17, and at a rear end with a second roller 16. The second rollers 16 on the slide rails 14 are adapted to rotate along the guide rails 13 for the drawer 11 to move in correct directions, and the stop plates 17 are adapted to press against tops of the first rollers 15, so that the drawer 11 may slide smoothly. The drawer 11 includes a front panel 18 that has a width larger than an overall width of an inlet on the furniture 10 for the drawer 11, so that the rail structure 12 could not be seen behind the front panel 18 when the drawer 11 is in a closed position. The front panel 18 also prevents the drawer 11 from being completely pushed into the inlet. Usually, the front panel 18 has a vertical position decided according to heights of outer ends of the stop plates 17 relative to the front panel 18. In the event the front panel 18 has two lateral ends located at different heights, a common solution is to dismount and remount the guide rails 13 to corrected positions. When the height difference between the two lateral ends of the front panel 18 is small, it might be neglected or ignored by a worker to save the trouble of remounting the guide rails 13. And, in the event the guide rails 13 could not be adjusted to desired height or inclination, the slide rails 14 must be dismounted and remounted to suitable positions for compensating errors in the positions of the guide rails 13.

SUMMARY OF THE INVENTION

A primary object of the present invention is to provide a drawer rail structure that allows easy adjusting of a vertical position of a front panel of the drawer, so that the front panel always has two lateral ends located at the same horizontal position.

Another object of the present invention is to provide a drawer rail structure that allows easy adjusting of a vertical position of a front panel of the drawer, so that a uniform space may be produced between the front panels of two vertically adjacent drawers to give a beautiful appearance to a piece of furniture on which the drawers are mounted.

To achieve the above and other objects, the drawer rail structure of the present invention includes a pair of guide rails fixedly mounted to predetermined positions on a piece of furniture, and a pair of slide rails fixedly mounted to predetermined positions on two side panels of a drawer. Each of the guide rails is provided at a front end with a first roller, and each of the slide rails is provided at an upper edge with an inward stop plate, and at a rear end with a second roller. The second rollers are adapted to rotate along the guide rails, and the stop plates are adapted to press against tops of the first rollers, so that the drawer is guided by the guide and slide rails to slide in correct directions. An adjusting screw is downward screwed into each stop plate at an outer end thereof, and a spring plate is located below the adjusting screw to press against the top of the first roller. When the adjusting screw is screwed into the stop plate to move the spring plate to a different height, a front panel of the drawer may be adjusted to a different vertical position.

The adjusting screw may be very easily operated to achieve the purpose of adjusting the drawer front panel. Moreover, the adjusting screw may be steplessly turned to allow fine adjustment thereof, so that the front panel of the drawer may be finely adjusted for the two lateral ends thereof to locate at almost the same horizontal position.

By separately adjusting the two lateral ends of the front panel of the drawer, the space between two vertical adjacent drawers may be changed.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 3-1 is an enlarged view of the circled area of FIG.

DETAILED DESCRIPTION OF THE PREFERRED EMBODIMENTS

Figure 1:
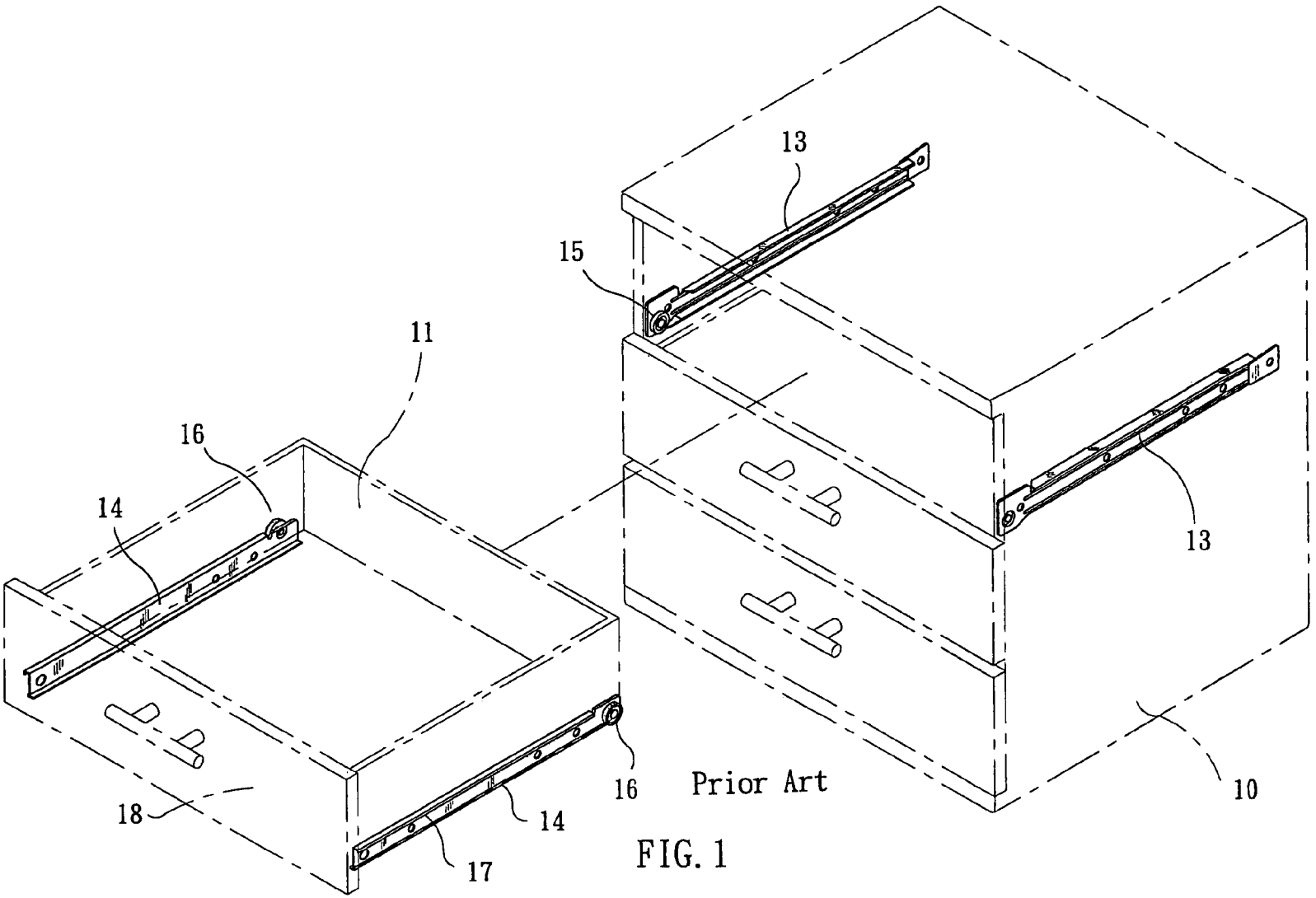
Prior Art FIG. 1
FIG. 1 is an exploded perspective view showing a conventional rail structure for drawer.
Figure 2:
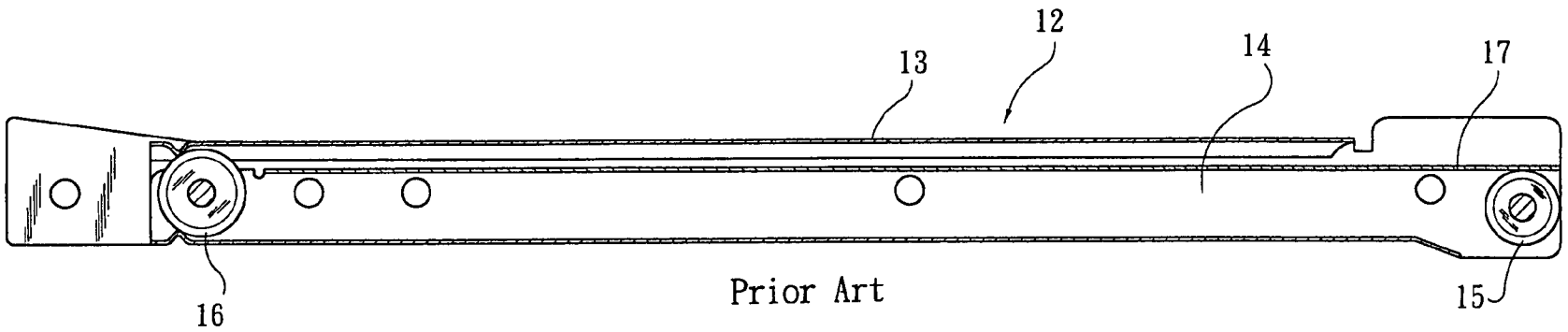
Prior Art FIG. 2
FIG. 2 is a sectional view of the rail structure for drawer shown in FIG. 1.
Figure 4:
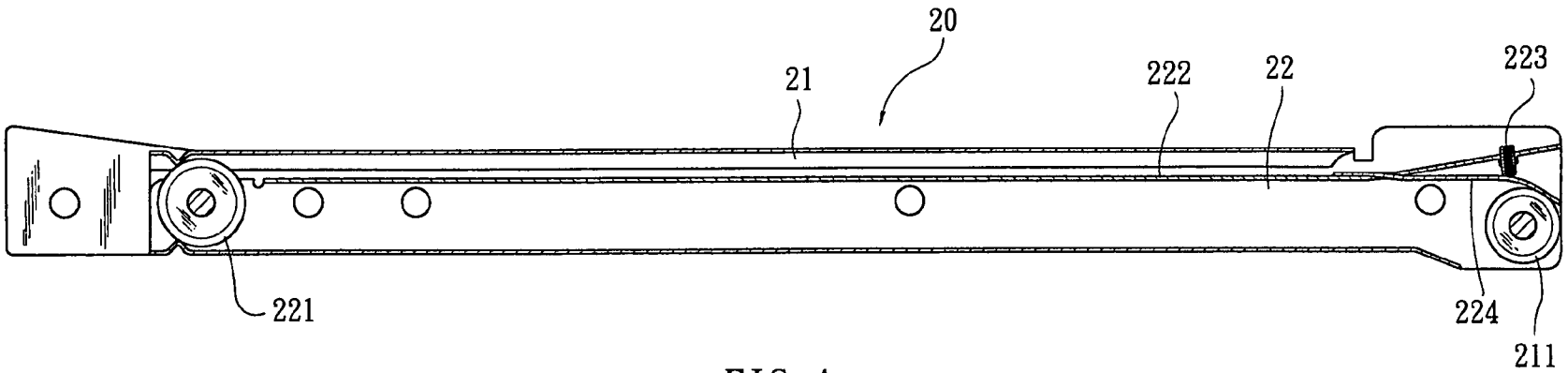
FIG. 4 is a sectional view of the drawer rail structure of FIG. 3.
Figures 1, 3:
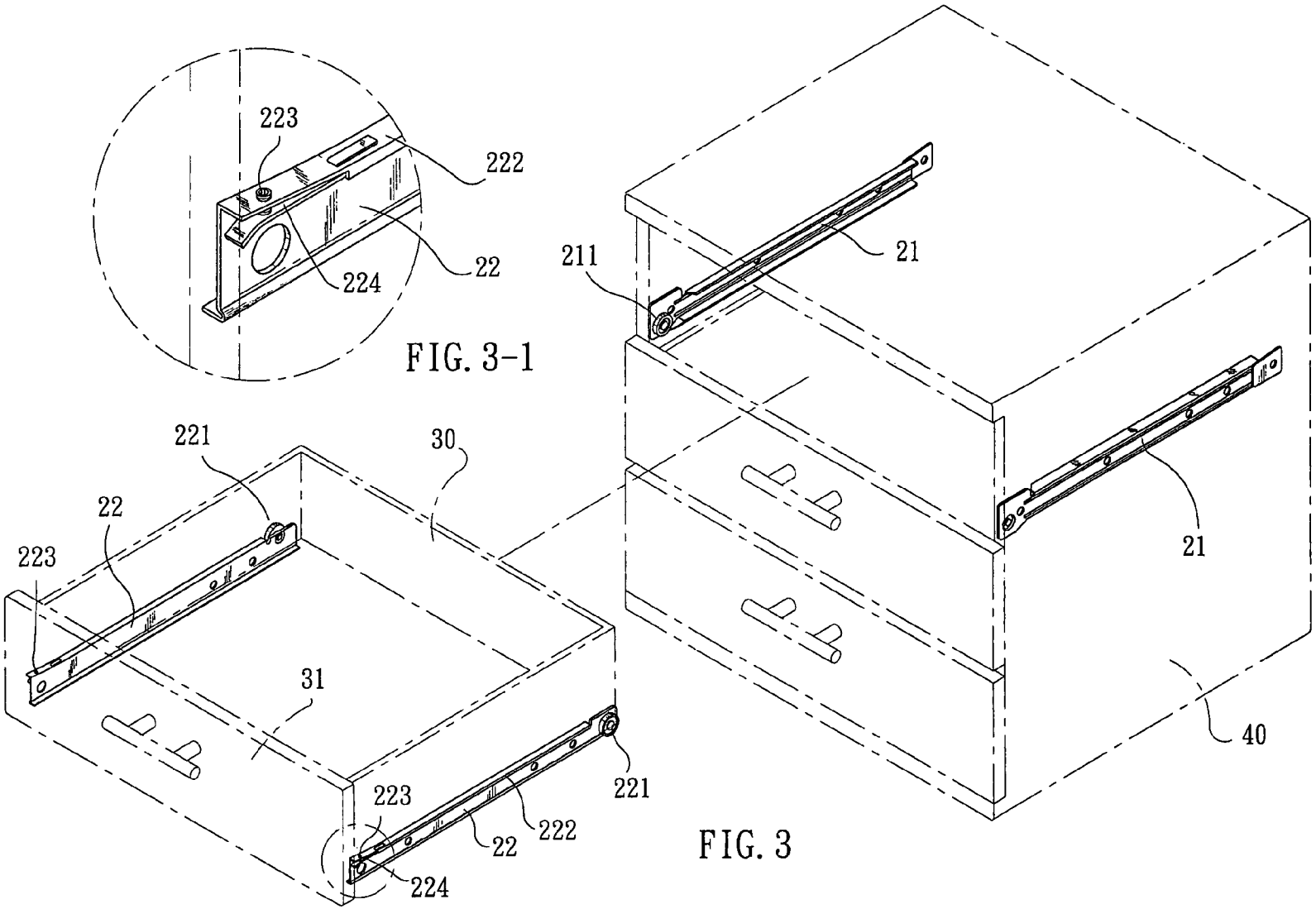
FIG. 3 is an exploded perspective view showing a drawer rail structure allowing adjusting of vertical position of drawer front panel according to the present invention.

Please refer to FIGS. 3, 3-1, and 4 in which a drawer rail structure 20 allowing adjusting of vertical position of a drawer front panel according to the present invention is shown. As shown, the drawer rail structure 20 is provided for guiding a drawer 30 to slide correctly and mainly includes a pair of guide rails 21 fixedly mounted to predetermined positions in a piece of furniture, such as a cabinet 40, and a pair of slide rails 22 fixedly mounted to predetermined positions on two side panels of the drawer 30. Each of the guide rails 21 is provided at a front end with a first roller 211. And, each of the slide rails 22 is provided at an upper edge with a laterally inward extended stop plate 222, and at a rear end with a second roller 221. When the drawer 30 is guided into the cabinet 40 by the guide rails 21, the second rollers 221 on the pair of slide rails 22 rotates in the guide rails 21, and the stop plates 222 on the upper edges of the two slide rails 22 are pressed against a top of the first rollers 211 at the front end of the guide rails 21, so that the drawer 30 slides in correct directions. Please refer to FIG. 3-1. Each of the two stop plates 222 at the upper edges of the two slide rails 22 is provided at an outer end with a downward screwed adjusting screw 223 and a spring plate 224 below the adjusting screw 223. The spring plate 224 has an outer end located immediately below a lower end of the adjusting screw 223 and an inner end fixedly connected to the stop plate 222, such that the outer end of the spring plate 224 is in a freely movable state. When the drawer 30 is fully pushed into the cabinet 40 along the guide rails 21, the spring plates 224 are pressed against tops of the first rollers 211 on the outer ends of the guide rails 21. When the adjusting screw 223 is downward screwed, the corresponding spring plate 224 is pushed by the lower end of the adjusting screw 223 to move downward. At this point, a lateral end of a front panel 31 of the drawer 30 corresponding to the slide rail 22 having the downward pushed spring plate 224 is lifted to a higher position. Reversely, when the adjusting screw 223 is turned in an opposite direction to move upward relative to the stop plate 222, the outer end of the spring plate 224 is allowed to spring upward, and thereby allows the front panel 31 of the drawer 30 to locate at a lower position. In this manner, a user may conveniently change the vertical position of the front panel 31 of the drawer 30 simply by screwing the adjusting screw 223 into the stop plate 222 by different depths.

To adjust the vertical position of the front panel 31 of the drawer 30, the user needs not to remove the drawer 30 from the cabinet 40, but simply pulls out the drawer 30 by a small distance to show the outer ends of the two slide rails 22. The user may then use a suitable tool (not shown) to change the screwing depth of the adjusting screw 223 into the stop plate 222, and thereby change a vertical position of the outer end of the spring plate 224 relative to the stop plate 222. The two adjusting screws 223 may be separately turned to adjust the vertical positions of the two lateral ends of the front panel 31.

Figure 5:
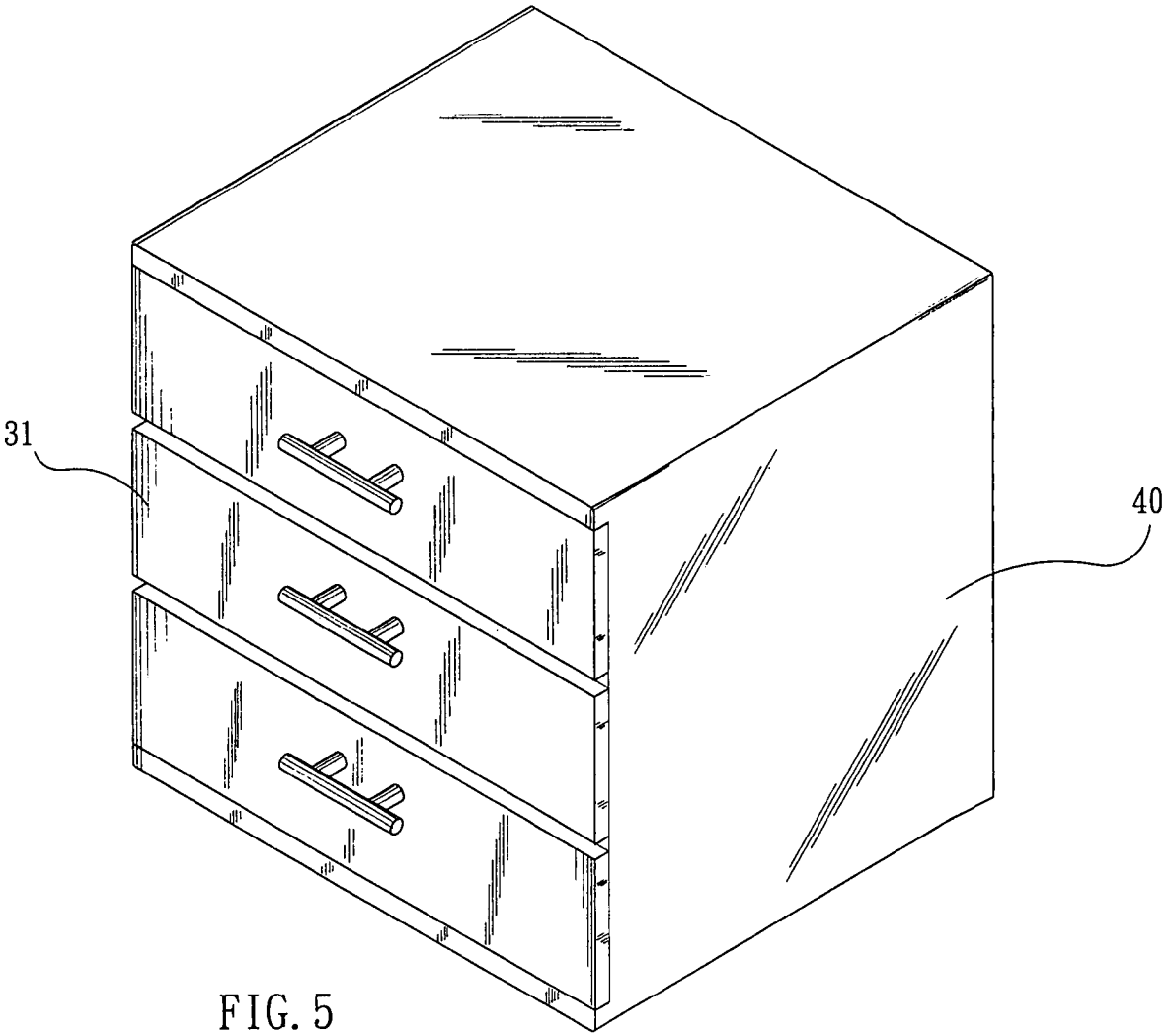
FIG. 5 is a perspective view of a cabinet with drawers.

FIG. 5 shows an example of cabinet 40 having more than two or more drawers 30. A user may adjust the vertical positions of two lateral ends of each front panel 31, so that the front panels 31 of the drawers 30 on the cabinet 40 are horizontally spaced at equal distance, giving the whole cabinet 40 a quality appearance.

In brief, the present invention employs simple structure to enable adjusting of vertical position of the drawer front panel without the need of dismounting any part of the drawer rail structure, and is therefore very practical for use.

What is claimed is:

1. A drawer rail structure allowing adjusting of vertical position of drawer front panel, comprising a pair of guide rails fixedly mounted to predetermined positions on a piece of furniture, and a pair of slide rails fixedly mounted to predetermined positions on two side panels of a drawer;

each of said guide rails being provided at a front end with a first roller; each of said slide rails being provided at an upper edge with a laterally inward extended stop plate, and at a rear end with a second roller; said second roller on said slide rails being adapted to rotate along said guide rails, and said stop plates on the upper edges of said slide rails being adapted to press against tops of said first rollers on the front ends of said guide rails, so that said drawer is guided by said guide and said slide rails to slide into and out of said piece of furniture in correct directions;

said drawer rail structure being characterized in that each of said stop plates on the upper edges of said slide rails is provided at an outer end with a downward screwed adjusting screw, and a spring plate below said adjusting screw; said spring plate having an inner end fixed to said stop plate and an outer end located immediately below a lower end of said adjusting screw in a freely movable state; and said spring plates being adapted to press against tops of said first rollers on the front ends of said guide rails.

* * * * *